US006803853B2

(12) United States Patent
Schneider et al.

(10) Patent No.: US 6,803,853 B2
(45) Date of Patent: Oct. 12, 2004

(54) TESTING DEVICE FOR OPERATION TESTING OF A TEMPERATURE SENSOR OF AN ALARM OR AN ALARM AND A METHOD OF OPERATION TESTING OF AN ALARM

(75) Inventors: Joachim Schneider, Nattheim (DE); Anton Pfefferseder, Sauerlach-Arget (DE); Bernd Siber, Glonn (DE); Andreas Hensel, Vaihingen (DE); Ulrich Oppelt, Zorneding (DE)

(73) Assignee: Robert Bosch GmbH, Stuttgart (DE)

( * ) Notice: Subject to any disclaimer, the term of this patent is extended or adjusted under 35 U.S.C. 154(b) by 238 days.

(21) Appl. No.: 09/933,093

(22) Filed: Aug. 20, 2001

(65) Prior Publication Data

US 2002/0021224 A1 Feb. 21, 2002

(30) Foreign Application Priority Data

Aug. 18, 2000 (DE) ..... 100 40 570

(51) Int. Cl.[7] ..... G08B 29/00

(52) U.S. Cl. ..... 340/514; 340/506; 340/511; 340/628; 73/23.2

(58) Field of Search ..... 340/514, 515, 340/506, 511, 554, 567, 584, 595, 603, 605, 618, 629, 628, 630; 73/232

(56) References Cited

U.S. PATENT DOCUMENTS

| | | | | | |
|---|---|---|---|---|---|
| 3,693,401 | A | * | 9/1972 | Purt et al. | 73/1.05 |
| 4,418,268 | A | * | 11/1983 | Munshaw | 219/241 |
| 4,428,434 | A | * | 1/1984 | Gelaude | 169/13 |
| 4,538,137 | A | * | 8/1985 | Kimura | 340/512 |
| 5,245,979 | A | * | 9/1993 | Pursifull et al. | 123/690 |
| 5,586,061 | A | * | 12/1996 | Williams et al. | 702/130 |
| 5,686,896 | A | * | 11/1997 | Bergman | 340/636 |
| 5,693,873 | A | * | 12/1997 | Thuries et al. | 73/23.28 |
| 5,772,403 | A | * | 6/1998 | Allison et al. | 417/44.2 |
| 6,397,661 | B1 | * | 6/2002 | Grimes et al. | 73/24.06 |

* cited by examiner

*Primary Examiner*—Daryl Pope

(57) ABSTRACT

An operation testing of a temperature sensor of an alarm includes spraying so that the sprayable material is sprayable on the temperature sensor, a temperature decrease due to the spraying is detected, and an operation ability is determined in dependence on the testing.

19 Claims, 3 Drawing Sheets

TESTING DEVICE FOR OPERATION TESTING OF A TEMPERATURE SENSOR OF AN ALARM OR AN ALARM AND A METHOD OF OPERATION TESTING OF AN ALARM

BACKGROUND OF THE INVENTION

The present invention relates to a testing device for testing operation of a temperature sensor of an alarm or an alarm, and, a method of testing operation of an alarm.

It is known that fire alarms in Germany must be tested in accordance with the regulation VDE 0833 at least once per year with respect to its operation. When the fire alarm has a smoke detector and a temperature sensor, then the smoke detector and the temperature sensor must be tested separately with respect to their corresponding functions. The temperature sensor is tested by hot air.

SUMMARY OF THE INVENTION

Accordingly, it is an object of the present invention to provide a testing device for operation testing of a temperature sensor of an alarm or an alarm, and a method of operation testing of an alarm, which are further improvements of the existing solutions.

In keeping with these objects and with others which will become apparent hereinafter, one feature of present invention resides, briefly stated in a testing device for operation testing of a temperature sensor of an alarm, which has a testing device for operation testing of a temperature sensor of an alarm, comprising a spraying source with a sprayable material; a testing cup fittable over a temperature sensor; a valve arranged on the spraying source for letting out the sprayable material and extending into said testing cup, the valve having a valve opening adapted to be arranged in a vicinity of the temperature sensor, so that the sprayable material is sprayable on the temperature sensor.

It is another object of the present invention to provide a method of operation testing of a temperature sensor of an alarm which includes spraying the temperature sensor with a sprayable material by a testing device; testing a temperature decrease of the spraying with the sprayable material; and indicating an operativeness of the temperature sensor in dependence on the testing.

In accordance with the present invention, the temperature sensor is tested with a sprayable material, for example an aerosol, which is sprayed on it and thereby causes a temperature decrease. Therefore, means for providing electrical energy as required in the case of hot air are not needed. The spraying with the sprayable material of the temperature sensor leads to a cooling and thereby to an opposite temperature course to the one which occurs during a fire, which can be easily used as a criterium for a testing model.

Moreover, the measurement with aerosol is utilized also for the simultaneous operation test of a smoke detector. Therefore by a single positioning of the testing device, both measuring processes of the smoke detector and the temperature sensor can be performed for testing their operations. This leads to a simplified, faster and easier testing of a fire alarm.

It is especially advantageous that in accordance with the present invention the switching of the alarm to a testing mode can be performed either by a central unit connected to the alarm or by a switch located on the alarm or by remote operation or by the alarm itself. Thereby it is guaranteed that the testing mode is recognized and adjusted, and thereby the operation ability of the temperature sensor and in some cases of the smoke detector is tested.

In particular, with the use of aerosol and another sprayable material for the operation testing of the temperature sensor, it is possible that the alarm recognizes an operation testing itself, and the fast cooling is performed by spraying of the temperature sensor with aerosol, which otherwise is not expected. A temperature gradient of −10° C./sec can be expected, which does not happen in a normal case. Since many alarms, in particular in professional area, are connected to a central unit, for example through a bus, therefore through the central unit, when the operation testing must be performed, the alarms are signaled so that they are adjusted to the testing mode.

A further possibility resides in that, during the triggering of the operation testing process either by the testing device or by an operator remotely, the testing mode of the alarm is activated.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

A testing of fire alarms, in particular such which are provided with a temperature sensor and a smoke detector and arranged in large halls and buildings where the fire alarm is located a few meters above the ground on the ceiling, is a difficult work.

In accordance with the present invention a method for operation testing of temperature sensors is proposed, which is also usable for the operation testing of smoke detectors and is performed for both sensors, namely the temperature sensor and the smoke detector. For this purpose aerosols are utilized, which are sprayed on the temperature sensor and activate there a proportional temperature decrease by the temperature decrease and/or by the evaporation of the drive medium. Furthermore, the aerosol leads to the situation that an available smoke detector is tested with respect to its operation by the aerosol, which imitates a smoke. In order to set a fire alarm into a testing mode, in which it recognizes that an operation testing of the temperature sensor and in some cases of the smoke detector is performed, a central unit connected to the fire alarm, or a switch available on the alarm, or an own intelligence of the alarm are utilized.

Aerosols are liquid droplets which are located in a gas, here a drive medium or propellant. They are present as a fog. With a gas flow which is caused by spraying, a pressure reduction and an evaporation of the drive medium is performed, which leads as well known to a proportional temperature decrease. If only a temperature sensor is tested, also another sprayable material can be used, to provide a fast temperature decrease, such as for example water or propanol.

Figure 1:
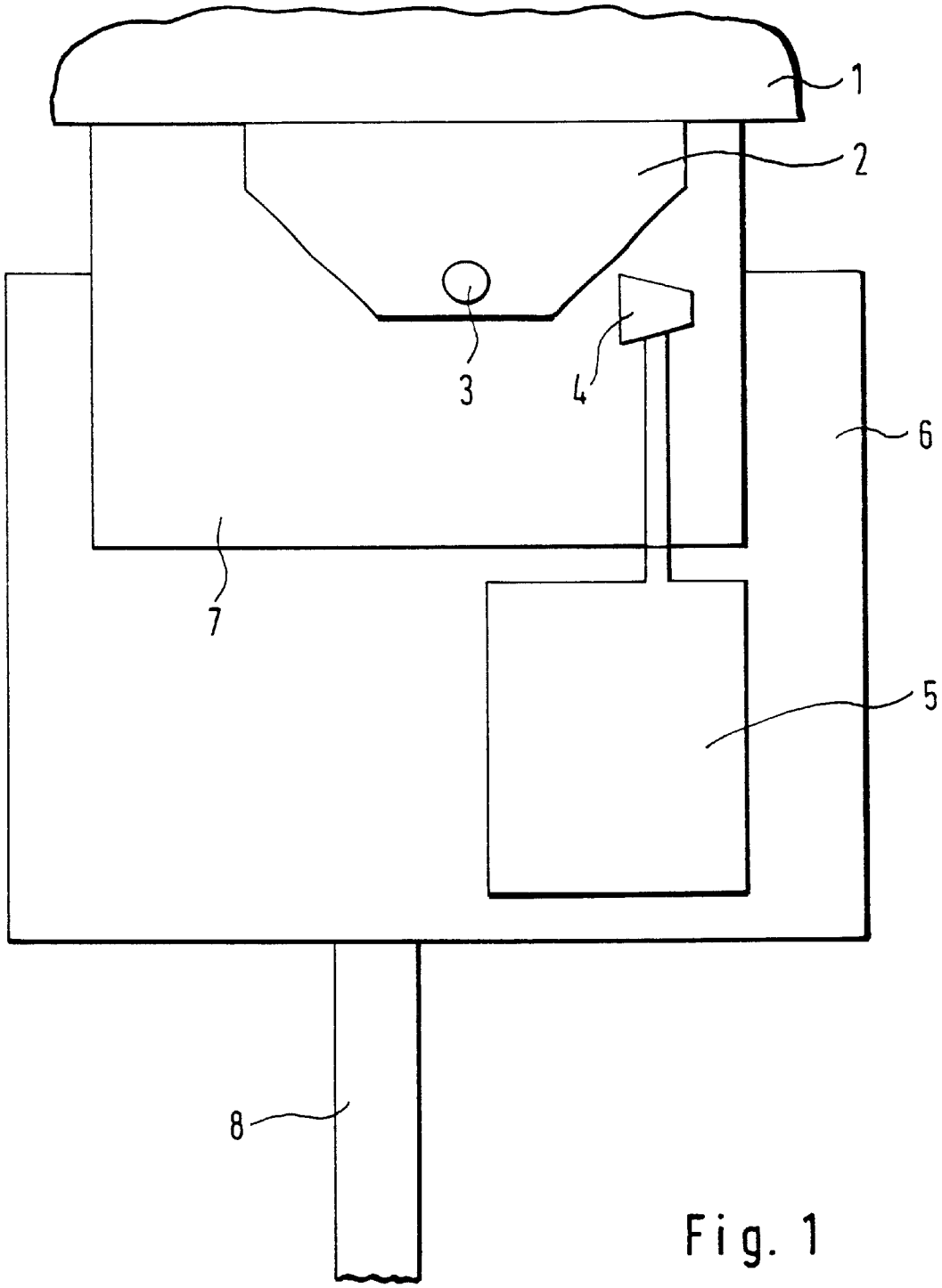
FIG. 1 is a view showing a testing device for an alarm in accordance with the present invention.

FIG. 1 shows the inventive testing device in use with an alarm. An alarm 2 is arranged on a ceiling 1, which alternatively can be also a wall. The alarm 1 has a temperature sensor 3. Moreover it is possible that the alarm 2, which is here formed as a fire alarm, has an additional smoke detector. A smoke detector as conventional can have a labyrinth-like passage, through which the smoke penetrates through the alarm in the event of fire, to reach a measuring chamber were an optical measurement of a smoke detection is performed.

A valve 4 is oriented with its opening to the temperature sensor 3, so that an aerosol which flows out of the opening is sprayed directly onto the temperature sensor 3. The valve 4 is arranged on a line which is connected to a spraying can 5. The spraying can 5 contains the aerosol with a propellant which is present in the spraying can 5 as a liquid. The spraying can 5 is located inside a housing 6 of the testing device while the valve 4 is located inside a testing cup 7 which is fitted over the alarm 2 to perform measurements. The housing 6 surrounds the testing cup 7 and is mounted on it.

Alternatively it is possible that the spraying can 5 extends into the testing cup 7, and passages through the testing cup 7 for example for the lines are sealed. Therefore, the aerosol which is sprayed by the valve 4 into the testing cup 7 remains in the testing cup to be ready for the measurement. The testing cup 7 is mounted on the wall or pressed on it. The housing 6 of the testing device is held by a rod 8. The rod 8 serves as an operator to fit the testing device over the alarm. The testing cup 7 of the housing 6 can be composed of a transparent synthetic plastic material, so that the operator can perform a simple placing of the inventive testing device. It is therefore avoided that the valve 4 abuts against the alarm 2 and can damage the same. The spraying can 5 is mounted on the housing 6, for example by clamps, so as to provide a possibility for a simple exchange of the spraying can 5. FIG. 1 does not show means for opening of the valve, which can be formed purely mechanically or electromechanically.

Figure 2:
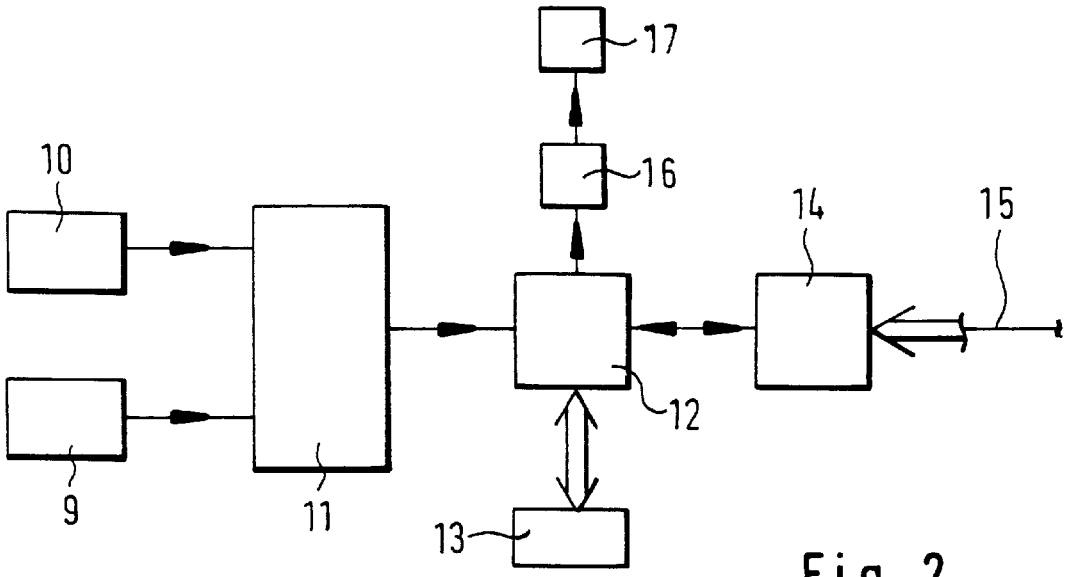
FIG. 2 is a view showing a block diagram of the inventive alarm system, which is connected to a central unit.

FIG. 2 shows a block diagram of a first embodiment of the inventive alarm. A temperature sensor 9 and a smoke detector 10 are connected through their outputs to a signal processing unit 11, and in particular to the first and second inputs. A data output of the signal processing unit 11 leads to a data input of a processor 12. A first data input/output of the processor 12 leads to a memory 13. A second data input/output of the processor 12 leads to a communication block 14, while a second data input/output of the communication block 14 is connected to a communication line 15. A data output of the processor 12 leads to a signal processing device 16, with which the means 17 for optical and acoustic visitation is connected. The means 17 for optical and acoustical reproducing are here a light and a siren, wherein only the light or only the siren can be used or a loudspeaker can be utilized.

The sensors, the temperature sensor 9 and the smoke detector 10, supply signals to the signal processing unit 11. The signal processing unit 11 amplifies and digitizes these sensor data. Furthermore, the signal processing device 11 forms a multiplex of the signals, which then are transmitted to the processor 12.

The processor 12 performs an analysis of the sensor data, and in a normal operation these sensor data are compared with threshold data to perform a fire detection. These threshold values are stored in the memory 13 which is also used as an operational memory for the processor 12.

If through the communication line 15 a signal is transmitted from a central unit connected to the communication line 15, that the alarm 2 is switched to a testing mode, then the processor 12 evaluates the testing signals as to whether a normal operation of the sensors 9 and 10 is provided. This is also performed with respect to the threshold value which is in the memory 13. Alternatively it is possible to transmit these measuring values of the central unit through the communication line 15, so that the central unit performs the evaluation. When the processor 12 performs the evaluation, it can indicate the same by means 17 for optical and acoustic representation. It the central unit performs this, then the central unit transmits corresponding signal to the alarm 2, so that moreover by the means 17 for acoustic and optical presentation an available or a failing operation can be indicated.

The signal processing unit 16 converts a command coming from the processor 12 into a corresponding signal for the siren and the like. The communication block 14, here a modem, connects the alarm to the communication line 15. Alternatively it is possible that the communication block 14 is formed as a bus controller and the communication line 15 is formed as a bus system for example the known LSN bus, interconnectable through the alarm. The signal processing unit unit 11 can be alternatively subdivided into two signal processing units dedicated to the corresponding sensor. It is composed of a corresponding signal amplifier and an analog/digital converter, and digitized signals are assembled in a multiplexer for forming the data flow for the processor 12.

Figure 3:
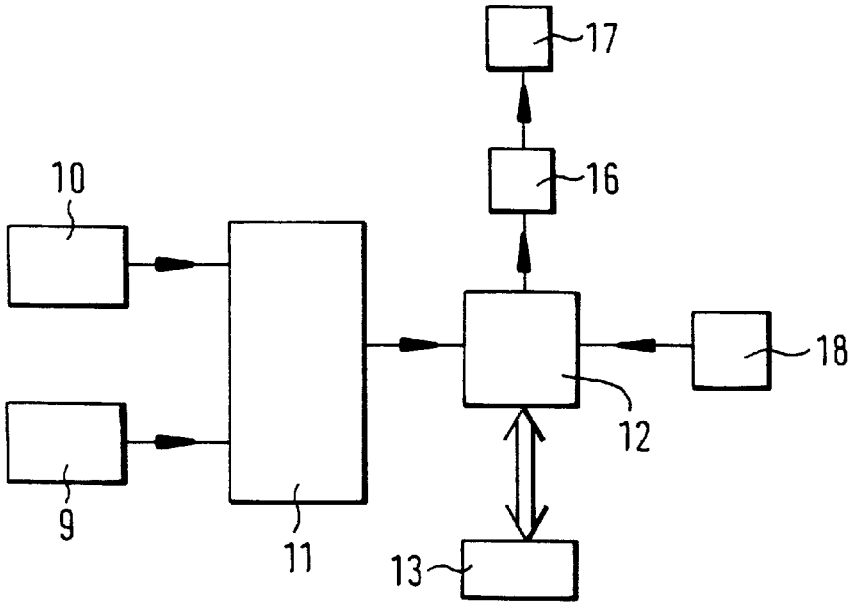
FIG. 3 is a view showing a block diagram of the alarm in accordance with the present invention, which has a switch or a receiver for activation in the test mode.
Figure 4:
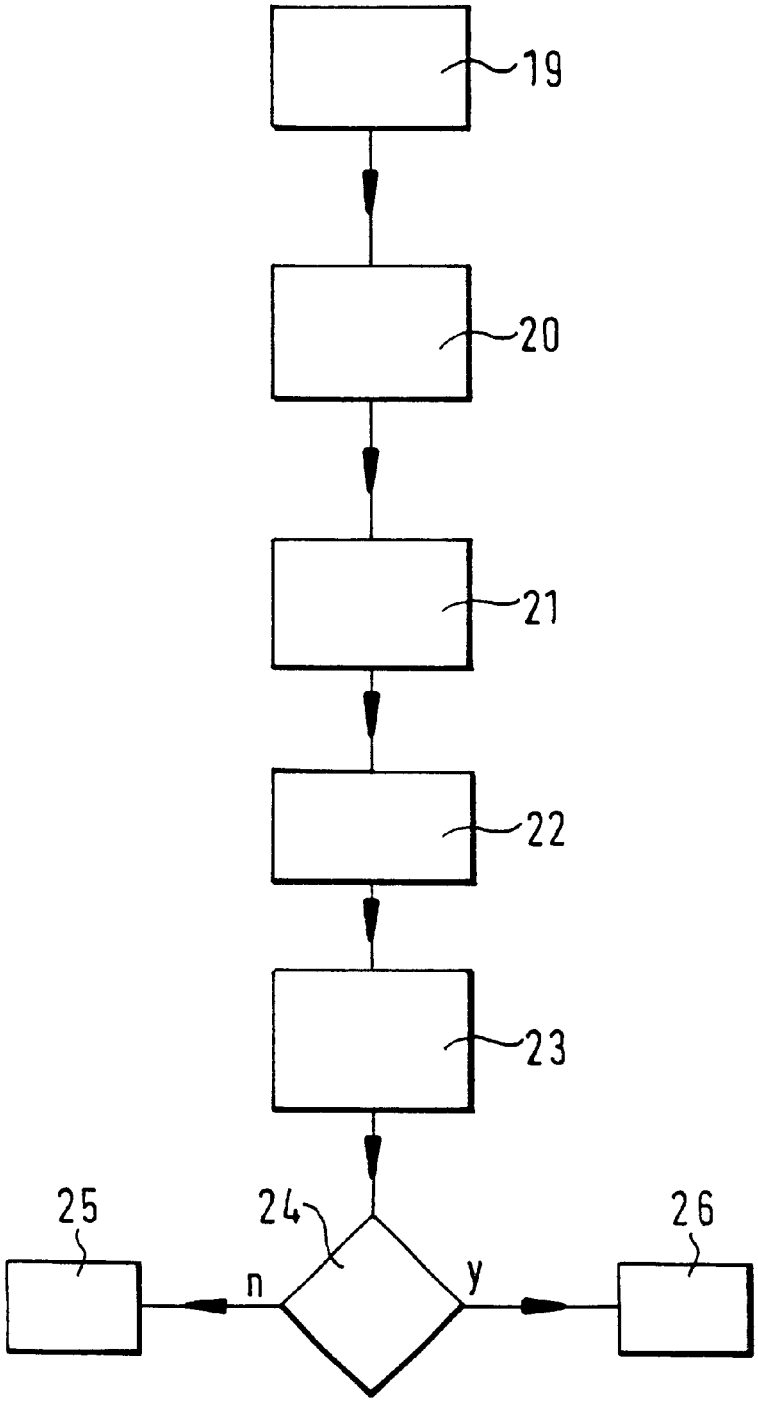
FIG. 4 is a flow diagram of a method in accordance with the present invention.

FIG. 3 shows a block diagram of the second embodiment of the alarm. The temperature sensor 9 and the smoke detector 10 are connected correspondingly to the first and second input of the signal processing unit 11. The signal processing unit 11 is connected to a first data input of the processor 12. A switch 18 is connected to a second data input of the processor 12. It indicates whether a testing mode is provided for the alarm 2 or not, and acts so as to switch the alarm 2 to the testing mode. The memory 13 is connected to a data input/output of the processor 12. The signal processing unit 16 is connected to a data input of the processor 12, and the means 17 for acoustic and optical indication are connected to the signal processing unit 16.

The switch 18 is formed as a Reed contact. With a Reed contact, a switch element is closed or opened by magnetized springs. Thereby the Reed contact 18 is accessible for an outwardly actuated magnetic fields. Such a magnet is mounted here in the testing device, for example in the housing 6, for actuation of the Reed contact 18 by this magnet. When then the testing cup 17 is fitted over the alarm 2, the magnet switches during the fitting of the read contact 18 so that the alarm 2 is switched to the testing mode. Alternatively it is possible to form the switch 18 as an infrared or as a radio interface with a connected electronic system, so that the alarm 2 is switchable to a testing mode by a remote operation with infrared signals or radio signals. For the radio signals, for example a Blue tooth is suitable which is utilized for transmission over short distances.

The inventive method for operation testing of the temperature sensor 3 and the alarm 2 is illustrated in form of a flow diagram. In the method step 19 the operator is introduced, in that the operator brings the testing device to the housing 6 and the testing cup 7 over the alarm 2, which is mounted on the ceiling 1. The operator uses the rod 8 for this purpose. In the method step 20 the alarm 2 is switched to the testing mode. This is performed either through a remote control operation by the operator as explained above, or by fitting of the testing device, so that the Reed contact 18 is actuated, or by a central unit connected to the alarm 2 which switches the alarm to the testing mode. Alternatively it is possible that the alarm 2 recognizes the signals coming from the temperature sensor 3, performs an operational testing, and thereby automatically switches in the testing mode.

In the method step 21 aerosol is sprayed from the spraying can 5 of the temperature sensor 3, through the valve 4 which is open by the user and leads to a fast temperature decrease. The processor 12 check this measured temperature increase whether the temperature sensor 3 operates properly. This is performed in the method step 22 which is provided for the temperature measurement and in the method step 23 whether the processor 12 performs the evaluation itself. In some cases the processor 12 performs the switching to the testing mode, if processor 12 detects that it deals with a testing signal. In some cases, also measuring signals of the smoke detector 10 are evaluated, as to whether the smoke detector 10 correctly detects smoke. In the method step 24 it is tested whether the processor determined that a correct operation of the smoke detector 10 and the temperature sensor 9 takes place. If this is the case, then in the method step 26 it is indicated that everything is in order. If this is not the case or the operation of at least one of the sensors 9 and 10 is not correct, then in the method step 25 an acoustic and optical indication is produced by the means 17. Alternatively, it is possible that it is transmitted additionally or instead to the central control unit.

It will be understood that each of the elements described above, or two or more together, may also find a useful application in other types of constructions differing from the types described above.

While the invention has been illustrated and described as embodied in testing of a temperature sensor of an alarm, an alarm and a method of operation testing of an alarm, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A testing device for operation testing of a temperature sensor of an alarm, comprising a spraying source with a sprayable material causing a temperature decrease; a testing cup fittable over a temperature sensor, a valve arranged on said spraying source for letting out the sprayable material and extending into said testing cup, said valve having a valve opening adapted to be arranged in a vicinity of the temperature sensor, so that the sprayable material is sprayable on the temperature sensor, and means for testing a temperature decrease due to the spraying.

2. A testing device as defined in claim 1, wherein said testing device is suitable for the operation testing of a smoke detector, wherein the sprayable material is an aerosol.

3. A testing device as defined in claim 1; and further comprising a magnet for switching alarm to a testing mode.

4. A testing device as defined in claim 1, wherein the alarm is switchable to a testing mode; and further comprising means for indication an operational ability of the alarm, said means being selected from the group consisting of an optical indicator, an acoustic indicator, and both.

5. A testing device as defined in claim 4; and further comprising connecting means for connecting the temperature sensor with a central control unit for providing a testing mode, so that in the testing mode the temperature sensor or the alarm during an operation testing of the temperature sprayed with the sprayable material a signal is produced at the central control unit in dependence on an operation testing.

6. A testing device as defined in claim 4; and further comprising a smoke detector which is testable simultaneously with the temperature sensor as to its operation by spraying the sprayable material formed as an aerosol.

7. A testing device as defined in claim 4; and further comprising a switch for switching to the testing mode.

8. A testing device as defined in claim 7, wherein said switch is formed as a Reed contact.

9. A testing device as defined in claim 1; and further comprising a processor for detecting an operation test of the temperature sensor and switching a processor to the testing mode.

10. A testing device as defined in claim 1; and further comprising a receiver selected from the group consisting of an infrared receiver and a radio receiver and provided in an alarm, and the alarm is switchable to the testing mode by signals selected from the group consisting of infrared signals and radio signals.

11. A method of operation testing of a temperature sensor in an alarm, comprising the steps of spraying the temperature sensor with a sprayable material causing a temperature decrease by a testing device; testing a temperature decrease due to the spraying with the sprayable material; and indicating an operation ability of the temperature sensor in dependence on the testing of the temperature decrease due to the spraying.

12. A method as defined in claim 11; and further comprising switching the alarm for the operation testing to a testing mode.

13. A method as defined in claim 12; and further comprising switching the alarm to the testing mode by a switch.

14. A method as defined in claim 13; and further comprising switching the switch by a magnet of a testing device.

15. A method as defined in claim 12; and further comprising switching the alarm to a testing mode by a central unit connected to the alarm.

16. A method as defined in claim 12 and further comprising recognizing an operation testing by the alarm and then switching to a testing mode.

17. A method as defined in claim 12; and further comprising switching the alarm to the testing mode by a remote operation.

18. A method as defined in claim 11; and further comprising simultaneously with operation al testing of the temperature sensor, testing an operation of a smoke detector located in the alarm, with a sprayable material formed as an aerosol.

19. A method as defined in claim 11; and further comprising performing a remote operation for switching the alarm to a testing mode as a transmitting station for signals selected from the group consisting of radio signals and infrared signals.

* * * * *